US005514528A

United States Patent [19]

Chen et al.

[11] Patent Number: 5,514,528

[45] Date of Patent: May 7, 1996

[54] PHOTOGRAPHIC ELEMENT HAVING IMPROVED BACKING LAYER PERFORMANCE

[75] Inventors: Janglin Chen; John F. DeCory, both of Rochester, N.Y.

[73] Assignee: Eastman Kodak Company, Rochester, N.Y.

[21] Appl. No.: 390,004

[22] Filed: Feb. 17, 1995

[51] Int. Cl.[6] ..... G03C 1/85; G03C 1/93

[52] U.S. Cl. ..... 430/530; 430/496; 430/501; 430/140; 430/523; 430/531

[58] Field of Search ..... 430/530, 531, 430/496, 501, 140, 523

[56] References Cited

U.S. PATENT DOCUMENTS

| | | | |
|---|---|---|---|
| 2,627,088 | 2/1953 | Alles et al. | 264/136 |
| 2,779,684 | 1/1957 | Alles | 430/535 |
| 3,501,301 | 3/1970 | Nadeau et al. | 430/535 |
| 3,919,156 | 11/1975 | Khanna et al. | 430/535 |
| 3,944,699 | 3/1976 | Mathews et al. | 430/533 |
| 4,087,574 | 5/1978 | Yamaguchi et al. | 427/412.4 |
| 4,098,952 | 7/1978 | Kelly et al. | 428/483 |
| 4,203,769 | 5/1980 | Guestaux | 430/631 |
| 4,363,872 | 12/1982 | Ealding | 430/532 |
| 4,394,442 | 7/1983 | Miller | 430/532 |
| 4,689,359 | 8/1987 | Ponticello et al. | 524/23 |
| 5,147,768 | 9/1992 | Sakakibara | 430/501 |
| 5,294,525 | 3/1994 | Yamauchi et al. | 430/530 |

*Primary Examiner*—Mark F. Huff
*Attorney, Agent, or Firm*—Robert A. Gerlach

[57] ABSTRACT

A photographic element comprising a polyester support and at least one light-sensitive layer on one side of the polyester support, an antistatic layer on the other side of the support, the antistatic layer including a conductive metal oxide in a hydrophilic binder, the antistatic layer being overcoated with a layer containing a cellulose ester binder, and a solvent cast subbing layer disposed between the antistatic layer and the polyester support.

21 Claims, No Drawings

PHOTOGRAPHIC ELEMENT HAVING IMPROVED BACKING LAYER PERFORMANCE

BACKGROUND OF THE INVENTION

1. Field of the Invention

This invention relates to photographic elements having improved backing layer performance and to a method of preparing such photographic elements.

2. Description of Related Art

It is widely known in the art that various layers of photographic elements are formed on a suitable substrate commonly referred to in the art as a film support. Cellulose triacetate and polyesters such as polyethylene terephthalate and polyethylene naphthalate are materials which are commonly employed for this purpose. Polyester supports, primarily because of their hydrophobic nature, require the presence of one or more subbing layers (adhesion-promoting layers) on the surface of the support in order that the layers coated on the support will properly adhere thereto in further operations to which the photographic element is subjected.

The layers coated on the backside or the side opposite to that bearing the light-sensitive photographic emulsions, also usually contain an antistatic layer. Conductive metal oxides in a hydrophilic binder have been found extremely useful for this purpose.

U.S. Pat. No. 4,203,769 is directed to radiation sensitive elements having an amorphous vanadium pentoxide antistatic layer. This antistatic layer is disposed on the film support on the side opposite the light-sensitive emulsion layers. It is also-disclosed in this patent that when polyester film supports are employed, subbing layers such as that described in U.S. Pat. Nos. 2,627,088 and 2,779,684 may be employed as anchoring layers. The antistatic layer may also be overcoated with a protective layer containing cellulose ester materials such as cellulose ether phthalate, and cellulose acetobutyrate.

It has been found that when photographic elements are prepared on polyester film supports having the backing layers as outlined above, that upon processing through normal processing apparatus utilizing the C-41 development chemistry, minute blisters are formed which is a serious disadvantage in that it interferes with the optical characteristic of the photographic element. The C-41 process and chemistry are described in *The British Journal of Photography Annual* (1988), pages 191–207. These blisters can be defined as minute areas where a loss of adhesion occurs between adjacent layers. This loss of adhesion or delamination occurs during the photographic processing operation and may remain after drying of the processed photographic element. The blisters can collapse and form crater-like structures which can be observed optically.

Further, in certain embodiments of photographic elements, the cellulosic layer overlying the antistat layer may be a transparent magnetic recording layer containing ferromagnetic particles. This structure permits information to be written magnetically into the transparent magnetic recording layer for subsequent read-out and application. The formation of blisters or crater-like structures on the surface or at the interface of any of the layers present on the backside of the photographic element interferes with both the magnetic recording and readout of this transparent magnetic recording layer. Further, abrasion of the surface may readily occur as a direct result of this deficiency by contact with magnetic recording and reading heads.

Therefore, there is a need to provide photographic elements free of the disadvantages outlined above.

SUMMARY OF THE INVENTION

The invention contemplates a polyester film support, photographic elements and a method of making such supports and elements having at least one light-sensitive layer on one side of the polyester support, an antistatic layer on the opposite side of the support where the antistatic layer includes a conductive metal oxide in a hydrophilic binder, the antistatic layer is overcoated with a layer containing a cellulose ester binder, and disposed between the antistatic layer and the polyester support is a solvent cast subbing layer.

DESCRIPTION OF PREFERRED EMBODIMENTS

The subbing layer coating compositions employed in the photographic industry are aqueous latex based materials as described in the above-mentioned U.S. Pat. Nos. 2,627,088 and 2,779,684, as well as U.S. Pat. Nos. 3,501,301; 3,944,699; 4,087,574; 4,098,952; 4,363,872; 3,919,156; 4,394,442; and 4,689,359. While the problems of blister formation has not been observed in commercial photographic films or described in the literature; with the particular physical structure assemblies and of the backside layers as described above, blisters are a serious problem when the subbing layer is applied as an aqueous latex.

The invention is applicable with regard to the formation of photographic backing layers and photographic elements on polyester film supports such as, for example, polyethylene terephthalate, polyethylene naphthalate; polyethylene terephthalate or polyethylene naphthalate having included therein a portion of isophthalic acid, 1,4-cyclohexane dicarboxylic acid or 4,4-biphenyl dicarboxylic acid is used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like. It is preferred in the operation of this invention that the film support be polyethylene naphthalate and most preferably that the polyethylene naphthalate be prepared from 2,6-naphthalene dicarboxylic acids or derivatives thereof.

In a preferred embodiment, the film support is initially treated with an adhesion promoting agent such as, for example, resorcinol, orcinol, catechol, o, m, and p-cresol, o, m, and p-chlorophenol, pyrogallol, 1-naphthol, 2,4-dinitrophenol, 2,4,6-trinitrophenol, 4-chlororesorcinol, 2,4-dihyroxytoluene, 1,3-naphthalenediol, 1,6-naphthalenediol, acrylic acid, the sodium salt of 1-naphthol-4-sulfonic acid, benzyl alcohol, trichloroacetic acid, dichloroacetic acid, o-hydroxybenzotrifluoride, m-hydroxy-benzotrifluoride, o-fluorophenol, m-fluorophenol, p-fluorophenol, chloral hydrate, and p-chloro-m-creosol. Mixtures of two or more adhesion promoters can be employed, if desired. p-Chloro-m-cresol is preferred.

The film support may also be treated with corona discharge, glow discharge, flame, electron bombardment, UV and the like to increase the adhesion to subsequently applied layers.

Following the treatment with the adhesion promoting agent and/or energy treatments, a suitable subbing layer to further promote adhesion of the layers applied subsequently is coated onto the film support. Any suitable subbing layer to promote adhesion may be used such as, for example, addition polymers including acrylic resins such as polymethyl methacrylate, polymethyl acrylate, polyethyl methacrylate, poly(styrene-co-methyl methacrylate); ethylenemethylacrylate copolymers, ethylene-ethylacrylate copolymers, ethylene-ethyl methacrylate copolymers; polystyrene and copolymers of styrene with any of the unsaturated monomers mentioned above; polyvinyl resins, such as, polyvinyl chloride, copolymers of vinyl chloride and vinyl acetate, polyvinyl butyral, polyvinyl acetal, ethylene-vinyl acetate copolymers, ethylene vinyl alcohol copolymers, ethylene-allyl alcohol copolymers, ethylene-allyl acetate copolymers, ethylene-allyl benzene copolymers, ethylene-allyl ether copolymers, and ethylene-acrylic copolymers; condensation polymers, such as, polyesters, polyurethanes, polyamides, polycarbonates, mixtures and blends thereof and the like. Preferred polymers suitable for the subbing layer include addition copolymers of monomers such as, vinyl chloride, vinylidene chloride, acrylonitrile, methacrylonitrile, alkyl acrylates where the alkyl group contains from one to six carbon atoms, such as, methyl, ethyl, propyl, butyl, isopropyl, pentyl, hexyl, and the like, acrylic acid, iraconic acid, monomethyl iraconic, and maleic acid, and the like. Suitable addition polymers for the formation of the subbing layer are described in U.S. Pat. Nos. 2,627,088; 3,501,301; 3,944,699; 4,087,574; 4,394,442; 4,098,952; 4,363,872; and 4,857,396; all of which are incorporated herein by reference.

The polymers per se disclosed in U.S. Pat. No. 3,501,301 are particularly preferred for operation in accordance with this invention. The most preferred polymers for use as a subbing layer in accordance with this invention are a terpolymer of vinylidene chloride, acrylonitrile, and acrylic acid and a copolymer of vinylidene chloride and acrylonitrile.

It is a requirement in accordance with this invention in order to solve the problem of blisters, outlined above, that the subbing layer be applied from an organic solvent solution. Any suitable solvent for applying the subbing layer to the substrate may be employed such as, for example, dichloromethane, ethyl acetate, methyl ethyl ketone, trichloromethane, carbon tetrachloride, ethylene chloride, trichloroethane, toluene, xylene, cyclohexanone, 2-nitropropane, and the like. Dialkyl ketones, for example, acetone, methyl ethyl ketone, diethyl ketone, methyl propyl ketone, methyl isopropyl ketone and the like are preferred. Methyl ethyl ketone is most preferred. Alcohols such as methanol, ethanol, propanol, butanol, isopropanol, and the like may be used in mixture with the above-mentioned solvents. In applying the subbing layer to the substrate, the ratio of polymer to solvent is not critical; however, the polymer to solvent ratio employed is preferably from about 0.1 to about 10 percent by weight. The subbing is then dried to remove the solvent and the antistat layer is next applied to the subbed film support.

The antistatic layer comprises conductive metal oxide particles in a hydrophilic binder. Any suitable conductive metal oxide can be employed including ZnO, $TiO_2$, $ZrO_2$, $SnO_2$, $Al_2O_3$, $In_2O_3$, $SiO_2$, MgO, BaO, $MoO_3$, metal antimonates, as described in U.S. Pat. No. 5,368,995 issued Nov. 29, 1994, and incorporated herein by reference, preferably $ZnSb_2O_6$ and $InSbO_4$; and $V_2O_5$ or composites thereof. Vanadium pentoxide as described in U.S. Pat. No. 4,203,769, incorporated herein by reference, is particularly preferred. When vanadium pentoxide is employed in the antistatic layer, it is preferred that the ratio by weight of vanadium pentoxide or silver doped vanadium pentoxide to polymer be from 1:100 to 2:1 and most preferably from 1:20 to 1:1.

The conductive metal oxide is dispersed in a suitable hydrophilic binder and applied to the subbed film support. Any suitable hydrophilic binder may be employed in the antistatic layer such as, for example, proteins including gelatin, colloidal albumin, or casein; cellulose compounds such as, carboxymethyl cellulose, hydroxyethyl cellulose, cellulose diacetate or cellulose triacetate, cellulose nitrate and blends of the above-mentioned cellulosics; saccharide derivatives, such as, agar, sodium alginate or starch derivatives; synthetic hydrophilic colloids, for example, polyvinyl alcohol, poly-N-vinylpyrrolidone, acrylic acid copolymers, polyacrylamide and derivatives and partially hydrolyzed products of these vinyl polymers and copolymers such as polyvinyl acetate or polyacrylic acid ester; natural materials such as rosin or shellac, and derivatives thereof; and other synthetic resins. Further, it is possible to use aqueous emulsions of styrene-butadiene copolymer, polyacrylic acid, polyacrylic acid ester or derivatives thereof, polyvinyl acetate, vinyl acetate-acrylic acid ester copolymer, polyolefin or olefin-vinyl acetate copolymer; polyamides, styrene and maleic anhydride copolymers, copolymers of ethylenically unsaturated monomers including methyl acrylate, methyl methacrylate, vinylidene chloride, iraconic acid, acrylonitrile, acrylic acid, and the like. The antistat layer may be applied as an aqueous or solvent dispersion of the metal oxide particles in the binder polymer. A terpolymer of acrylonitrile, acrylic acid and vinylidene chloride or a terpolymer of methyl acrylate, vinylidene chloride and itaconic acid are preferred.

In the application of the antistatic layer to the subbed film support, a suitable coating composition would employ from about 0.1 to about 10 percent by weight of the hydrophilic polymer, from about 0.1 to about 10 percent by weight of the conductive metal oxide particles and the balance water or an appropriate solvent mixture. Those solvents mentioned above with regard to the application of the subbing layer may be used here. Dispersing aids or coating aids are generally required in order to assure wettability and strong adhesion to the underlying layer. Also, the antistatic layer may be applied from solvent solutions of the binder polymer containing conductive metal oxide particles as described in U.S. Pat. No. 5,356,468 issued Oct. 18, 1994, incorporated herein by reference.

In accordance with the invention, a cellulose ester layer is provided over the surface of the antistatic layer in order to provide protection therefor. Any suitable cellulose ester layer may be employed, such as, for example, cellulose diacetate, cellulose triacetate, cellulose acetate butyrate, cellulose ether phthalate, cellulose nitrate, and mixtures thereof. The cellulose ester layer is applied from any suitable solvent such as, for example, dichloromethane, ethyl acetate, methyl ethyl ketone, trichloromethane, carbon tetrachloride, ethylene chloride, trichloroethane, toluene, xylene, cyclohexanone, 2-nitropropane, methanol, ethanol, propanol, acetone, and the like. It is preferred to use a mixture of the above solvents for this purpose.

The cellulose ester layer coated over the antistatic layer may also serve another purpose, that being as a binder for ferromagnetic particles. When ferromagnetic particles are employed in the cellulose ester layer coated over the antistatic layer, they are used in an amount in order to achieve a transparent magnetic layer for the purpose of recording information magnetically independently of the photographic function of the element. In this regard, U.S. patent application Ser. No. 08/173,793 filed Dec. 22, 1993 entitled "Photographic Element Having a Transparent Magnetic Layer and a Process of Preparing the Same" assigned to the same assignee as this application is incorporated herein by reference.

When the cellulose ester layer described above contains ferromagnetic particles and serves as a magnetic recording layer, it may be desirable to interpose between the antistatic layer and the magnetic recording layer an additional polymeric layer. This polymer layer may include any suitable polymer, such as polymers and copolymers of methacrylate esters, acrylate esters, styrene, vinyl acetate, olefins, acrylonitrile, vinyl chloride, or vinylidene chloride, as well as the cellulose esters and ethers previously mentioned. Cellulose diacetate, cellulose triacetate, and polymethyl methacrylate are preferred polymers. This layer is applied from a solvent solution wherein the solvent can be any of the previously mentioned materials for application of the cellulose ester layer.

Finally, a lubricating overcoat layer may be applied to the cellulose ester layer if desired in order to bring about satisfactory friction characteristics to the surface of the element. Suitable lubricants are described in Hatsumel Kyoukai Koukai Gihou No. 94-6023, published Mar. 15, 1994. Carnauba wax is a preferred lubricant for this purpose.

The opposite side of the support is coated with a plurality of layers, at least one of which is a silver halide containing light-sensitive layer.

The various layers applied to the support film can be coated on the film by various coating procedures used in coating films, including dip coating, air knife coating, curtain coating, or extrusion coating using hoppers of the type described in Beguin U.S. Pat. No. 2,681,294 issued Jun. 15, 1954.

While the invention is particularly applicable to color negative film, it is to be understood that the invention applies also to color reversal and black and white formats as well.

The invention will be further illustrated by the following examples:

EXAMPLE 1

To one surface of polyethylene naphthalate film support having a thickness of about 90 micrometers, the following steps are conducted sequentially:

Adhesion Promoting Treatment

A solution of 0.8 g of 4-chloro-3-methyl phenol and 99.2 g of ethyl alcohol are applied at 23.7 ml/m$^2$ and dried at 90° C. for 2 minutes.

Application Of Subbing Layer

The treated support structure above is coated at 18.3 ml/m$^2$ with a solution of 1.3 g of a copolymer of vinylidene chloride, acrylonitrile, and acrylic acid (monomer weight of ratio 78:15:07) dissolved in 98.7 g of methyl ethyl ketone and dried at 90° C. for 5 minutes.

Application of Antistatic Layer

A dispersion of 0.18 g of a latex copolymer of vinylidene chloride, acrylonitrile, and acrylic acid (monomer weight percent ratio 78:15:07); 0.25 g of silver doped vanadium pentoxide; 0.23 g of Triton TX-100 (a surfactant sold by Rohm and Haas) and 99.34 g of de-ionized water is applied at a coverage of 23.7 ml/m$^2$ to the subbing layer and dried at 90° C. for 2 minutes.

Application of Magnetic Layer in Cellulose Ester Binder

The following formulation is applied to the antistatic layer at a coverage of 44.1 ml/m$^2$ and dried at 70° C. for 2 minutes.

| | |
|---|---|
| Cellulose diacetate | 2.51 g |
| Cellulose triacetate | 0.115 g |
| Magnetic oxide Toda CSF-4085V2 | 0.113 g |
| Surfactant Rhodafac PE510 | 0.006 g |
| Alumina Norton E-600 | 0.076 g |
| Dispersing aid, Zeneca Solsperse 2400 | 0.004 g |
| 3M FC431 | 0.015 g |
| Dichloromethane | 67.919 g |
| Acetone | 24.257 g |
| Methyl acetoacetate | 4.851 g |

Application of Lubricating Layer

An overcoat of carnauba wax at a coverage of mg/m$^2$ is applied.

EXAMPLE 2

Example 1 is repeated, except that the film base is polyethylene terephthalate having the thickness of about 100 micrometers.

EXAMPLE 3

Example 1 is repeated except that the antistatic layer is changed in accordance with the following formulation:

| | |
|---|---|
| AQ29 (aqueous dispersible polyester from Eastman Chemicals) | 0.18 g |
| Silver doped vanadium pentoxide | 0.25 g |
| Triton TX-100 | 0.23 g |
| de-ionized water | 99.34 g |

EXAMPLE 4

Example 1 is repeated except that the binder for the subbing layer is a copolymer of vinylidene chloride and acrylonitrile (monomer weight ratio 80:20).

COMPARATIVE EXAMPLE C-1

Example 1 is repeated except that the following aqueous latex is applied in place of the subbing layer of that example at a coverage of 18.3 ml/m$^2$ and dried at 90° C. for 5 minutes.

| | |
|---|---|
| Latex copolymer of vinylidene chloride, acrylonitrile, and acrylic acid (monomer weight ratio of 78:15:07) | 0.80 g |
| Resorcinol | 0.27 g |
| Saponin | 0.10 g |
| De-ionized water | 98.83 g |

EXAMPLE 5–8 AND COMPARATIVE EXAMPLE C-2

A color photographic recording material is prepared by applying the following layers in the given sequence to the opposite side of each of the supports of Examples 1–4 and Comparative Example C-1, respectively, each of which is subbed with the composition described in Example 1 of U.S. Pat. No. 4,689,359. The quantities of silver halide are given in grams of silver per $m^2$. The quantities of other materials are given in g per $m^2$.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin

Layer 6 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol % iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 8 {Third (most) Green-Sensitive Layer} Green sensitized silver iodobromide emulsion [4 mol % iodide, average grain diameter 2.16 microns, average grain thickness 0.12 microns] at 1.00 g, magenta dye-forming image coupler M-1 at 0.0.72 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye-forming image coupler Y-1 at 0.090 g, yellow dye-forming image coupler Y-2 at 0.23 g, cyan dye-forming image coupler C-10.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsensitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The formulas for the component materials are as follows:

C-1:

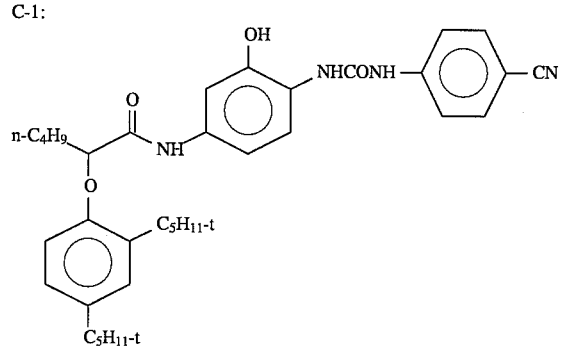

CM-1

-continued
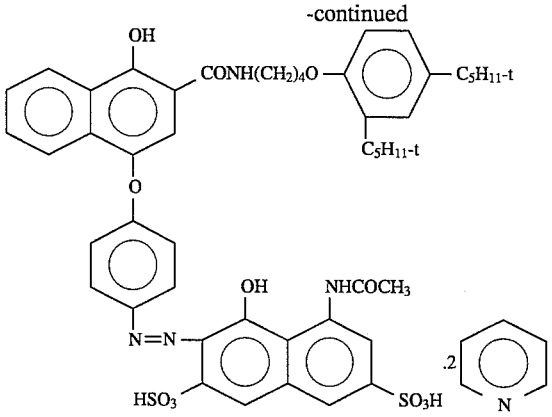
B-1
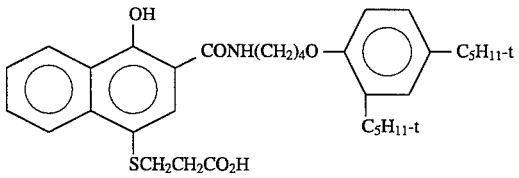
D-1:
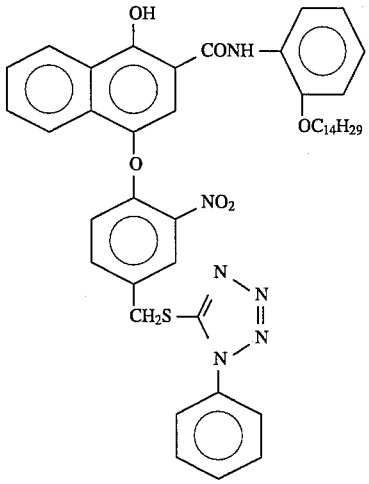
D-2
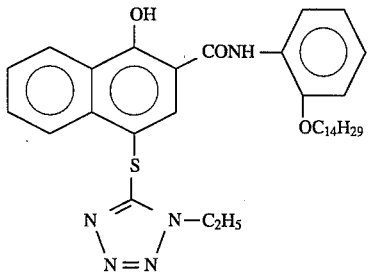
D-3:
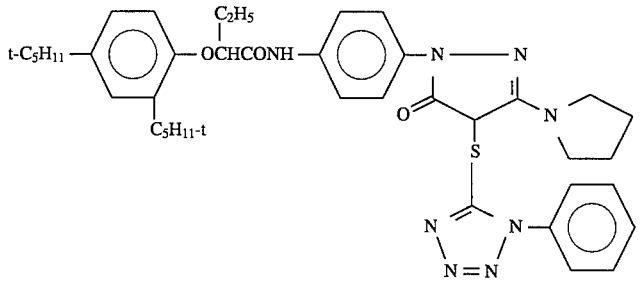

-continued
D-4
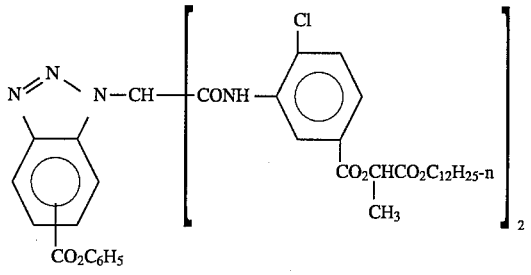
D-5:
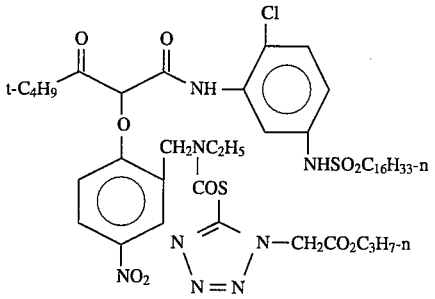
MM-1
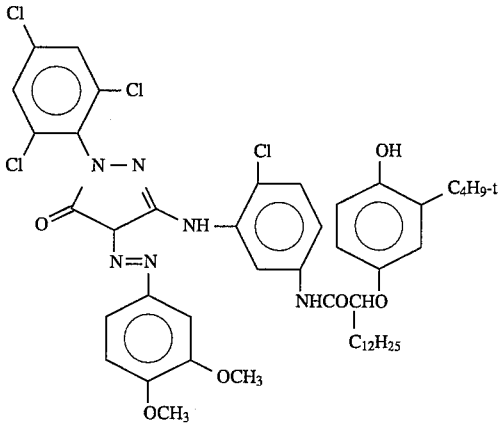
Y-1:
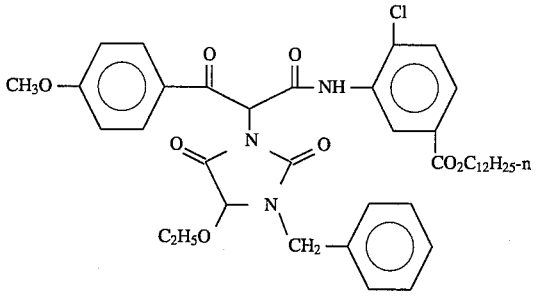
Y-2:

-continued
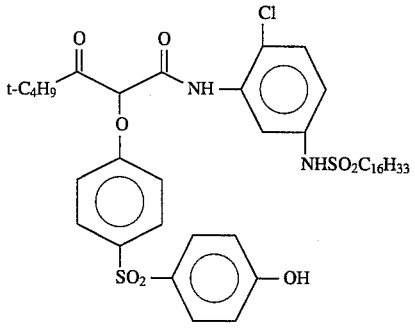
M-1:
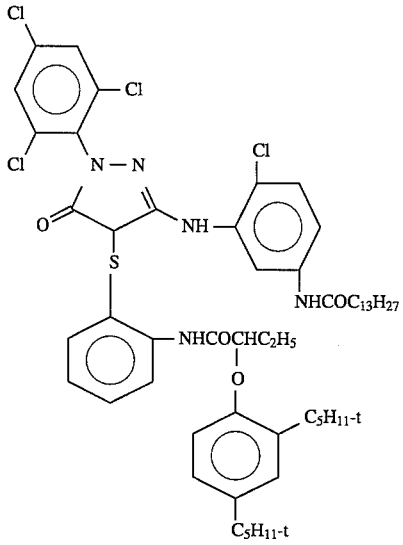
YD-1:
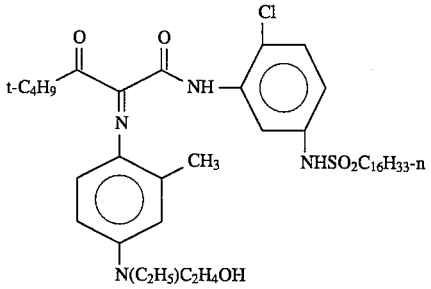
YD-2:
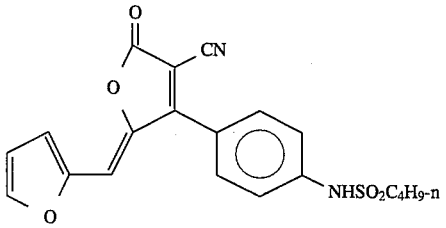
UV-1:
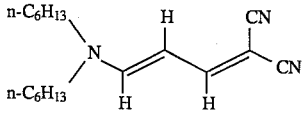
UV-2:

-continued

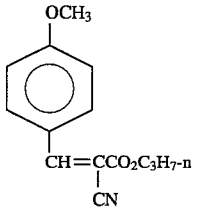

H-1:
$CH_2(SO_2CH{=}CH_2)_2$

Examination for Blisters

Each of the coated substrates in accordance with Examples 1 to 4 and C-1, and each of the photographic elements in accordance with Examples 5 to and C-2 are processed in a photographic development processor with the known C-41 color process as described in *The British Journal of Photography Annual* of 1988, pages 191–198. After the process, about 25 $cm^2$ each of the coated substrates and the photographic elements are examined for blisters on the backside of the film support, opposite to the photographic emulsion. Examination is assisted with an Olympus System Microscope, Model BH-2, with magnification set at 50X.

The results are set forth in Table 1.

TABLE 1

| | Blister Propensity | |
|---|---|---|
| Sample | | Blisters |
| Example 1 | (invention) | no blisters |
| Example 2 | (invention) | no blisters |
| Example 3 | (invention) | no blisters |
| Example 4 | (invention) | no blisters |
| Example C-1 | (comparison) | more than a hundred of blisters |
| Example 5 | (invention) | no blisters |
| Example 6 | (invention) | no blisters |
| Example 7 | (invention) | no blisters |
| Example 8 | (invention) | no blisters |
| Example C-2 | (comparison) | more than a hundred of blisters |

The invention has been described in detail with particular reference to preferred embodiments thereof, but it will be understood that variations and modifications can be effected within the spirit and scope of the invention.

What is claimed is:

1. A photographic element comprising a polyester support and at least one light-sensitive layer on one side of the polyester support, an antistatic layer on the other side of the support, the antistatic layer including a conductive metal oxide in a hydrophilic binder, the antistatic layer being overcoated with a layer containing a cellulose ester binder, and a solvent cast subbing layer disposed between the antistatic layer and the polyester support, the subbing layer being an addition or condensation polymer.

2. The photographic element of claim 1 wherein the subbing layer is an addition polymer.

3. The photographic element of claim 2 wherein the addition polymer is a copolymer that contains vinylidene chloride moieties.

4. The photographic element of claim 2 wherein the addition polymer is a copolymer that contains acrylonitrile moieties.

5. The photographic element of claim 2 wherein the addition polymer is a terpolymer of vinylidene chloride, acrylonitrile and acrylic acid.

6. The photographic element of claim 2 wherein the addition polymer is a copolymer of vinylidene chloride and acrylonitrile.

7. The photographic element of claim 1 wherein the polyester support is polyethylene terephthalate, polyethylene naphthalate, blends of polyethylene terephthalate with polyesters, polycarbonates, or polyurethanes, blends of polyethylene naphthalate with polyesters, polycarbonates, or polyurethanes, or polyester copolymers containing terephthalate or naphthalate units.

8. The photographic element of claim 1 wherein the metal oxide is tin oxide, vanadium pentoxide, zinc antimonate, or indium antimonate.

9. The photographic element of claim 1 wherein the cellulose ester layer overcoating the antistatic layer is a transparent magnetic recording layer.

10. The photographic element of claim 9 wherein a polymer layer is disposed between the magnetic recording layer and the antistatic layer.

11. The photographic element of claim 10 wherein the polymer layer is cellulose diacetate, cellulose triacetate, or polymethylmethacrylate.

12. The photographic element of claim 9 wherein a lubricating layer is disposed on the transparent magnetic recording layer.

13. A method of making a photographic film support having a plurality of backing layers applied thereto which comprises applying a polymeric subbing layer from an organic solvent to a polyester film base, applying an antistatic layer of a conductive metal oxide in a hydrophilic binder to the subbing layer, applying a cellulose ester layer to the antistatic layer.

14. The method of claim 13 wherein the subbing layer is an addition or condensation polymer.

15. The method of claim 14 wherein the subbing layer is an addition polymer.

16. The method of claim 15 wherein the addition polymer is a terpolymer of acrylic acid, acrylonitrile and vinylidene chloride.

17. The method of claim 15 wherein the addition polymer is a copolymer of vinylidene chloride and acrylonitrile.

18. The method of claim 13 wherein the solvent is a ketone.

19. The method of claim 18 wherein the ketone is methyl ethyl ketone, acetone, or mixtures thereof.

20. The method of claim 13 wherein the metal oxide of the antistatic layer is tin oxide, vanadium pentoxide, zinc antimonate, or indium antimonate.

21. The method of claim 13 wherein the cellulose ester layer overcoating the antistatic layer is a transparent magnetic recording layer.

* * * * *